US007226302B2

(12) United States Patent
Walter et al.

(10) Patent No.: US 7,226,302 B2
(45) Date of Patent: Jun. 5, 2007

(54) VACUUM CLEANER CURRENT-CARRYING HOSE CONNECTION SYSTEM

(75) Inventors: Scott Walter, Terrace (CA); Phillip N. Carter, Langley (CA); Bradley Ryan Madu, Langley (CA)

(73) Assignee: Scotech Systems Inc., Terrace, British Columbia (CA)

( * ) Notice: Subject to any disclaimer, the term of this patent is extended or adjusted under 35 U.S.C. 154(b) by 658 days.

(21) Appl. No.: 10/665,127

(22) Filed: Sep. 22, 2003

(65) Prior Publication Data

US 2005/0060838 A1 Mar. 24, 2005

(51) Int. Cl.
*H01R 4/60* (2006.01)

(52) U.S. Cl. ..... 439/191; 15/377; 174/47; 285/7

(58) Field of Classification Search ..... 439/191, 439/192, 23, 577; 15/377, 414; 174/47; 285/7

See application file for complete search history.

(56) References Cited

U.S. PATENT DOCUMENTS

| | | | | |
|---|---|---|---|---|
| 3,017,654 | A | 1/1962 | Allenby et al. | |
| 3,034,085 | A | 5/1962 | Pauler et al. | |
| 3,082,289 | A | 3/1963 | Allen | |
| 3,127,227 | A | 3/1964 | Edwards | |
| 3,211,823 | A | 10/1965 | Brown et al. | |
| 3,327,049 | A | 6/1967 | Brown et al. | |
| 3,470,521 | A | 9/1969 | Downey | |
| 3,546,656 | A | 12/1970 | Pritulsky | |
| 3,553,629 | A | 1/1971 | Brown et al. | |
| 3,928,715 | A | 12/1975 | Holden | |
| 3,986,737 | A | 10/1976 | Krusche | |
| 4,018,493 | A | 4/1977 | Lyman et al. | |
| 4,063,790 | A | 12/1977 | Kleykamp et al. | |
| RE29,666 | E | 6/1978 | Reynolds et al. | |
| 4,152,014 | A | 5/1979 | Soefker | |
| 4,188,081 | A | 2/1980 | Holden et al. | |
| 4,211,438 | A | 7/1980 | Asberg | |
| 4,283,594 | A | 8/1981 | Somers | |
| 4,345,805 | A * | 8/1982 | Finley et al. | 439/191 |
| 4,473,923 | A | 10/1984 | Neroni et al. | |
| 4,550,958 | A * | 11/1985 | Smith | 439/13 |
| 4,634,197 | A | 1/1987 | Horlacher, Jr. | |

(Continued)

FOREIGN PATENT DOCUMENTS

| | | |
|---|---|---|
| DE | 3225913 | 1/1984 |

(Continued)

*Primary Examiner*—Gary F. Paumen
(74) *Attorney, Agent, or Firm*—Oyen Wiggs Green & Mutala LLP

(57) ABSTRACT

A vacuum cleaner current-carrying hose connection system is disclosed having a female connection end on a first vacuum cleaner current-carrying hose adapted for receiving a male connection end on a second vacuum cleaner current-carrying hose. The male connection has at least two male receptor plugs configured for inserting into female receptor holes in the female connection end.

A vacuum cleaner hose connection system is further disclosed having a male connection end that has at least two male receptor plugs for transmitting current, a female connection end having at least two female receptor holes for receiving the male receptor plugs, and the male and female connection ends being rotatably movable, about the longitudinal axis of at least one of the female connection end and the male connection end, between an unengaged position and an engaged position.

15 Claims, 9 Drawing Sheets

U.S. PATENT DOCUMENTS

| | | | |
|---|---|---|---|
| 4,639,055 | A | 1/1987 | Keane |
| 4,787,117 | A | 11/1988 | Westergren |
| 4,826,444 | A | 5/1989 | Genoa et al. |
| 4,846,712 | A | 7/1989 | Holden et al. |
| 4,881,909 | A | 11/1989 | Blackman |
| 4,894,020 | A | 1/1990 | Holden et al. |
| 4,940,415 | A | 7/1990 | Westergren |
| 4,969,837 | A | 11/1990 | Genoa et al. |
| 5,007,839 | A | 4/1991 | Holden et al. |
| 5,069,635 | A | 12/1991 | Holden et al. |
| 5,387,017 | A | 2/1995 | Gill |
| 5,401,061 | A | 3/1995 | Yamashita |
| 5,755,578 | A * | 5/1998 | Contant et al. ..... 439/23 |
| 5,797,162 | A | 8/1998 | Vystrcil et al. |
| 6,108,861 | A | 8/2000 | Vystrcil et al. |
| 6,378,166 | B1 | 4/2002 | Bruno et al. |
| 2005/0022338 | A1 | 2/2005 | Muhlenkamp |
| 2005/0095889 | A1 * | 5/2005 | Saitou et al. ..... 439/191 |

FOREIGN PATENT DOCUMENTS

| | | | |
|---|---|---|---|
| DE | 3643498 | A1 | 6/1988 |
| EP | 0882422 | | 5/1998 |
| EP | 1062902 | | 6/2000 |
| JP | 11267075 | | 10/1999 |

* cited by examiner

VACUUM CLEANER CURRENT-CARRYING HOSE CONNECTION SYSTEM

TECHNICAL FIELD

The invention relates to vacuum cleaners, and particularly to a connection system for connecting a vacuum cleaner current-carrying hose to a second vacuum cleaner current-carrying hose, to a handle part, to a vacuum cleaner body or to a wall outlet.

BACKGROUND

Many modern vacuum cleaners transmit electrical current from the body of the vacuum cleaner to a power nozzle via wires arranged in a helix along the length of the vacuum cleaner hose. Typical vacuum cleaner current-carrying hoses have a first end adapted to receive current from the body of the vacuum cleaner and a second end adapted to transmit current to a handle part.

A significant limitation of existing vacuum cleaner current-carrying hoses is that the first and second ends do not use the same connection system so that two current-carrying hoses cannot be coupled together in a manner that would enable an extension current-carrying hose to be added between the first current-carrying hose and the handle part. There exists a need for a connection system for vacuum cleaner current-carrying hoses and handles that will allow a vacuum cleaner current-carrying hose to be connected to either a handle part or to a second current-carrying hose.

SUMMARY OF INVENTION

According to the present invention, a vacuum cleaner current-carrying hose connection system has a female connection end on a first vacuum cleaner current-carrying hose adapted for receiving a male connection end on a second vacuum cleaner current-carrying hose. The male connection has at least two male receptor plugs configured for inserting into female receptor holes in the female connection end.

The invention also provides for vacuum cleaner hose connection system having a male connection end that has at least two male receptor plugs for transmitting current, a female connection end having at least two female receptor holes for receiving the male receptor plugs, and the male and female connection ends being rotatably movable about the longitudinal axis of the female connection end between an unengaged position and an engaged position.

The invention provides a vacuum cleaner handle part having a male connection end adapted for engagement with a female connection end on a current-carrying hose, the female end being rotatably movable about the longitudinal axis of the female end between a position engaged with the handle part and an unengaged position.

The invention provides a female connection end for a vacuum cleaner current-carrying hose having at least two female receptor holes for receiving male receptor plugs carrying current and means for engaging with a male connection end via rotation about a longitudinal axis of the female connection end.

The invention provides a male connection end for a vacuum cleaner current-carrying hose having at least two male receptor plugs for transmitting current to female receptor holes and means for engaging with a female connection end via rotation about a longitudinal axis of the male connection end.

BRIEF DESCRIPTION OF DRAWINGS

In Figures which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
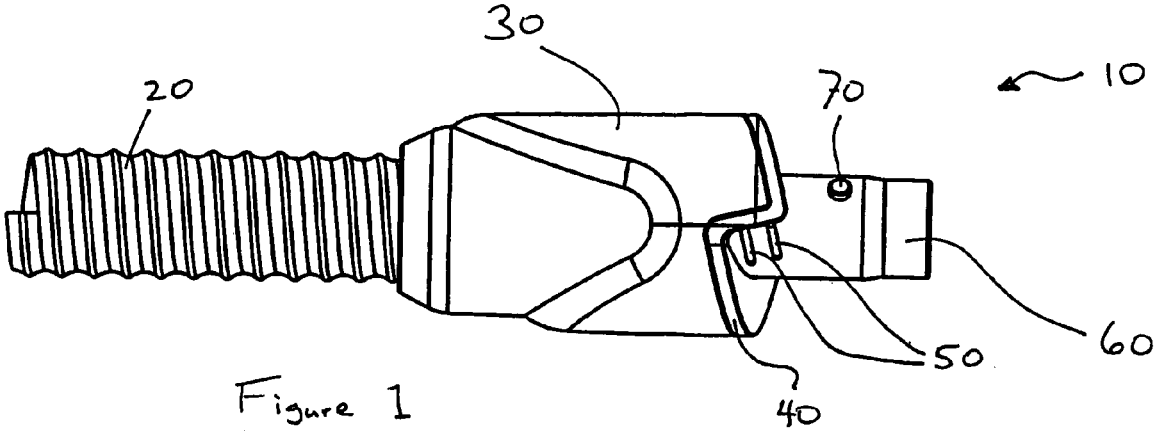
FIG. 1 is a side view of a preferred embodiment of a male connection end of the system of the present invention.
Figure 2:
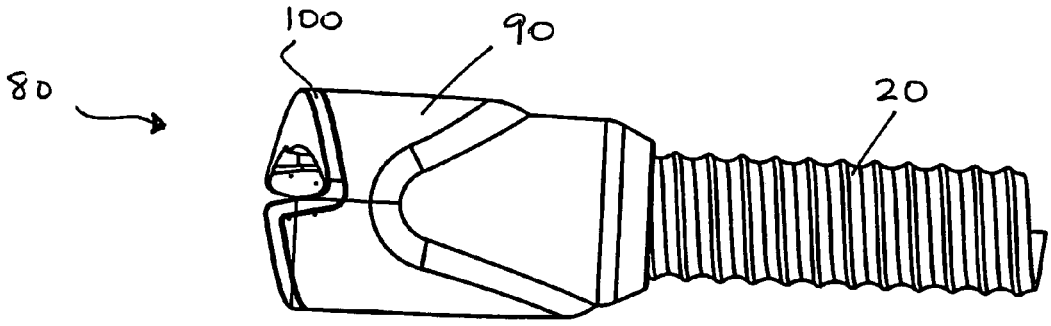
FIG. 2 is a side view of a preferred embodiment of a female connection end.

FIGS. 1 and 2 show a male connection end 10 and a female connection end 80 of a current-carrying hose system made in accordance with a preferred embodiment of the invention. The male connection end 10 and the female connection end 80 are both connected to a flexible vacuum hose 20 having a current-carrying cord wound round in a helix. The male connection end 10 has a hard shell 30 that is snugly attached to the male connection end's contoured leading lip 40. Two male receptor plugs 50 protrude from the contoured leading lip 40. An inner vacuum tube member 60 protrudes out of the male connection end 10 and has a guide button 70 on each side. Female connection end 80 has a hard protective shell 90 attached snugly to the female connection end's contoured leading lip 100.

Figure 3:
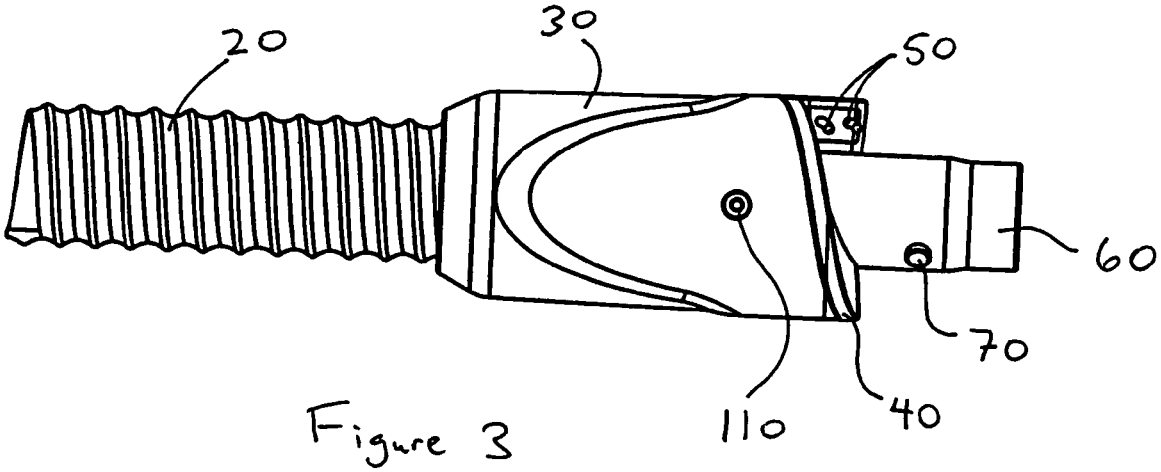
FIG. 3 is a top view of the male connection end shown in FIG. 1.

FIG. 3 shows a top view of the male connection end 10 according to the preferred embodiment of the invention, and shows a screw 110 that is used to attach the hard protective cover 30 to the remainder of the male connection end 10.

Figure 4:
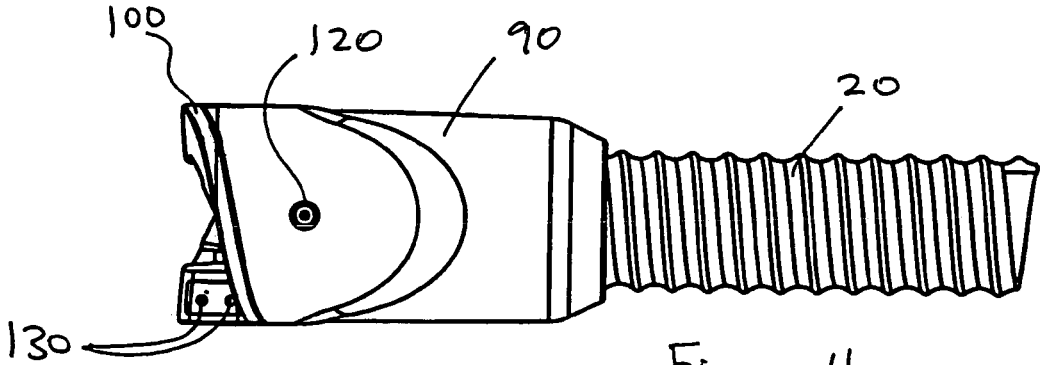
FIG. 4 is a top view of the female connection end shown in FIG. 2.

FIG. 4 shows a top view of the female connection end 80 according to a preferred embodiment of the invention, showing screw 120 that is used to attach the hard protective cover 90 to the remainder of the female connection end 80.

Figure 5:
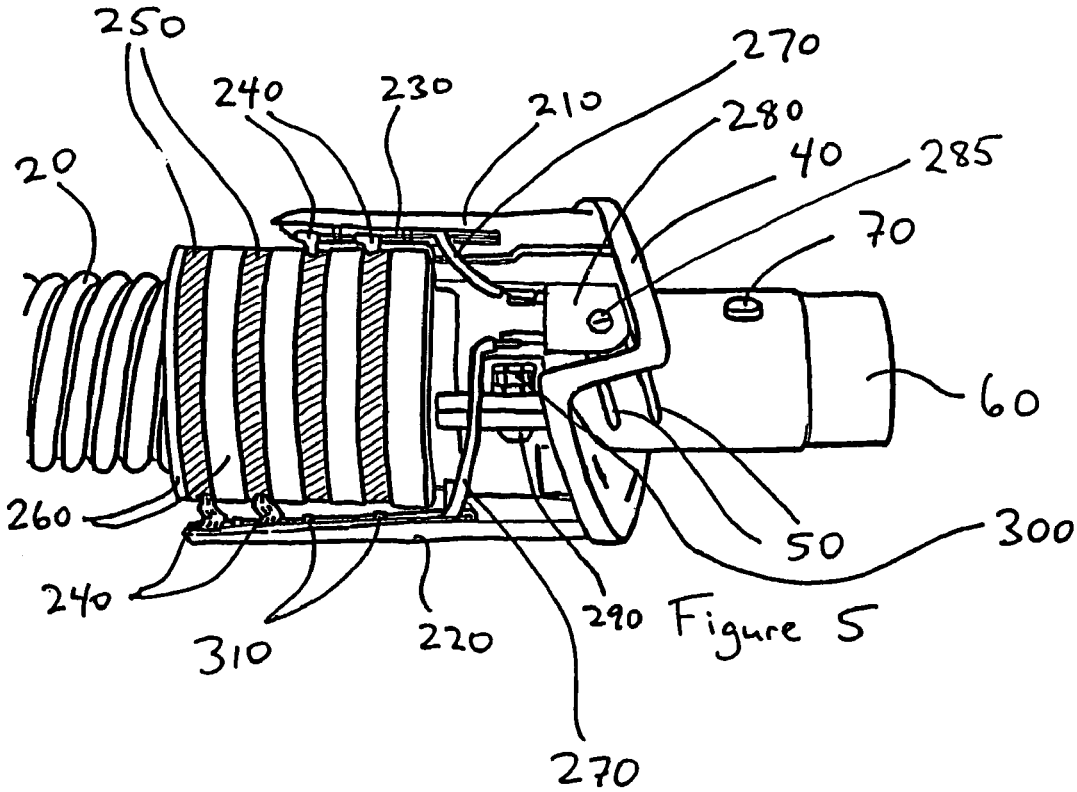
FIG. 5 is a first side view of the male connection end shown in FIG. 1 with the hard cover removed.
Figure 6:
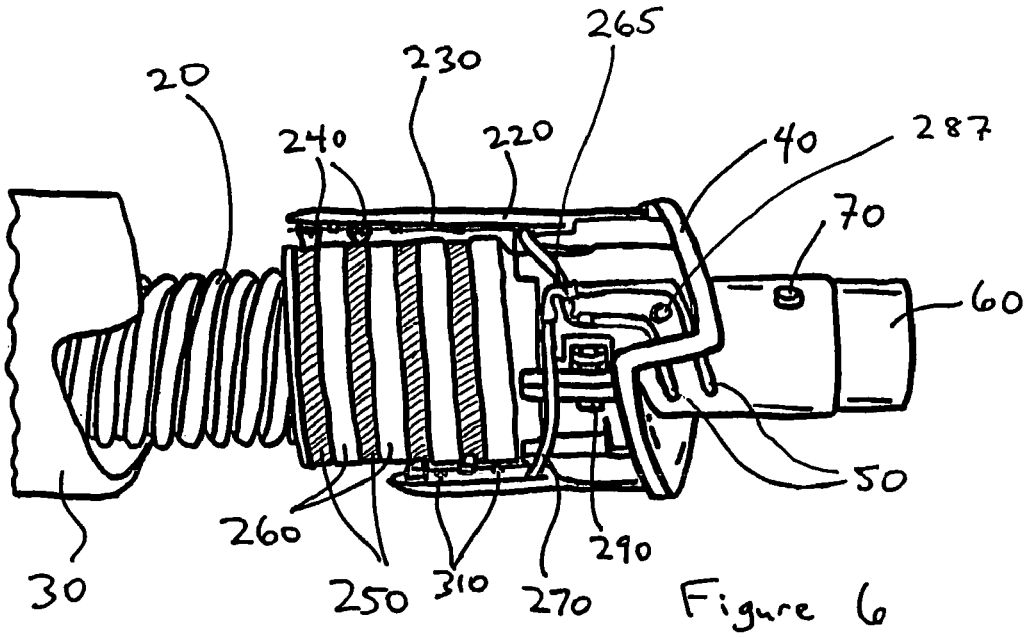
FIG. 6 is a second side view of the male connection end shown in FIG. 1 with the hard cover removed.

The inner portions of the male and female connection ends 010 and 80 are best illustrated with reference to FIGS. 5 to 8 showing the protective hard covers 30 and 90 removed. FIGS. 5 and 6 show the alternate side views for the male connection end 10. The male connection end 10 has a short flange 210 and a long flange 220, each protecting and attached to a circuit board 230. Each circuit board 230 is attached to two conducting leads 240, and each conducting lead 240 is in contact with one of four conducting loops 250. The four conducting loops 250 are spaced apart by insulating non-conducting loops 260. The conducting loops 250 and the insulating loops 260 extend circumferentially around the vacuum hose. The front portion of the male connection end 10, including the contoured leading lip 40 and the short and long flanges 210 and 220, is freely rotatable around a longitudinal axis extending through the inner vacuum tube member 60. Vacuum tube 60 extends into pipe 20 through a seal member. As the front end of the male connection end 10 rotates, the conducting leads 240 remain at all times in contact with the conducting loops 250. Spacer knobs 310 extend out of the short and long flanges 210 and 220, through the short and long circuit boards 230. The spacer knobs 310 hold the circuit boards 230 in position and help prevent the circuit boards 230 from touching the conducting loops 250.

Each conducting loop 250 is attached to one wire from the helix of wires in the current-carrying cord 20. Each conducting loop 250 is also connected to one conducting lead 240, which in turn is connected via a wire on the circuit board 230 to an insulated wire 270. For each conducting lead 240 on each circuit board 230, the electrical connection travels on an opposite side of the circuit board 230 to a separate insulated wire 270. Each insulated wire 270 is connected to one of the male receptor plugs 50. The connection between the insulated wires 270 and the male receptor plugs 50 is shown as a welded joint in FIGS. 5, 7, and 8 and is shown using female electric push/slide connectors 265 in FIG. 6. It is to be understood that the connection between the insulated wires 270 and the male receptor plugs 50 can be by any suitable means. The male receptor plugs 50 are attached firmly to the front portion of the male connection end 10 by a plug mounting cover 280, which in turn is held in place by a plug mounting screw 285 attached to a mounting screw receptacle 287. A screw 290 and nut 300 combination are shown in FIGS. 5 to 8 for firmly connecting two halves of the male receptor end, if the male receptor end is made by two pieces.

While FIGS. 5 and 6 are similar, they illustrate opposite sides of the male connection end 10. The configuration of the insulating wires 270 and the location of the short and long flanges 210 and 220 are slightly different for each side.

Figure 7:
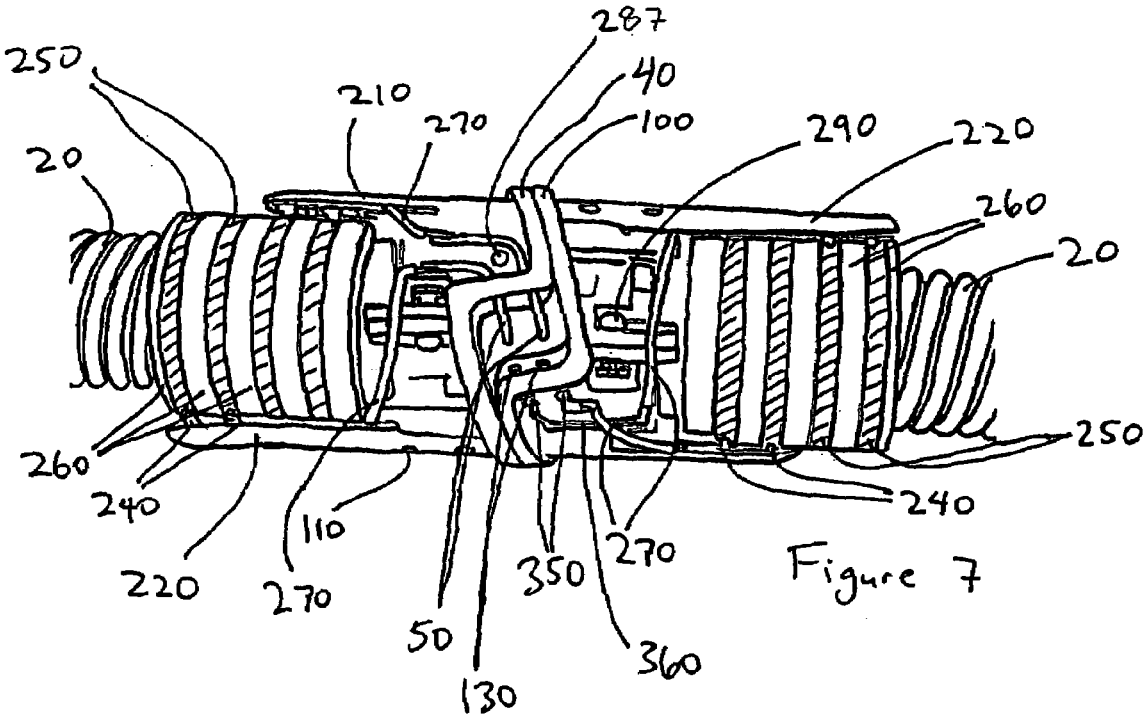
FIG. 7 is a side view of the male and female connection ends shown in FIGS. 1 and 2 with the hard covers removed and in a partially engaged position.
Figure 9:
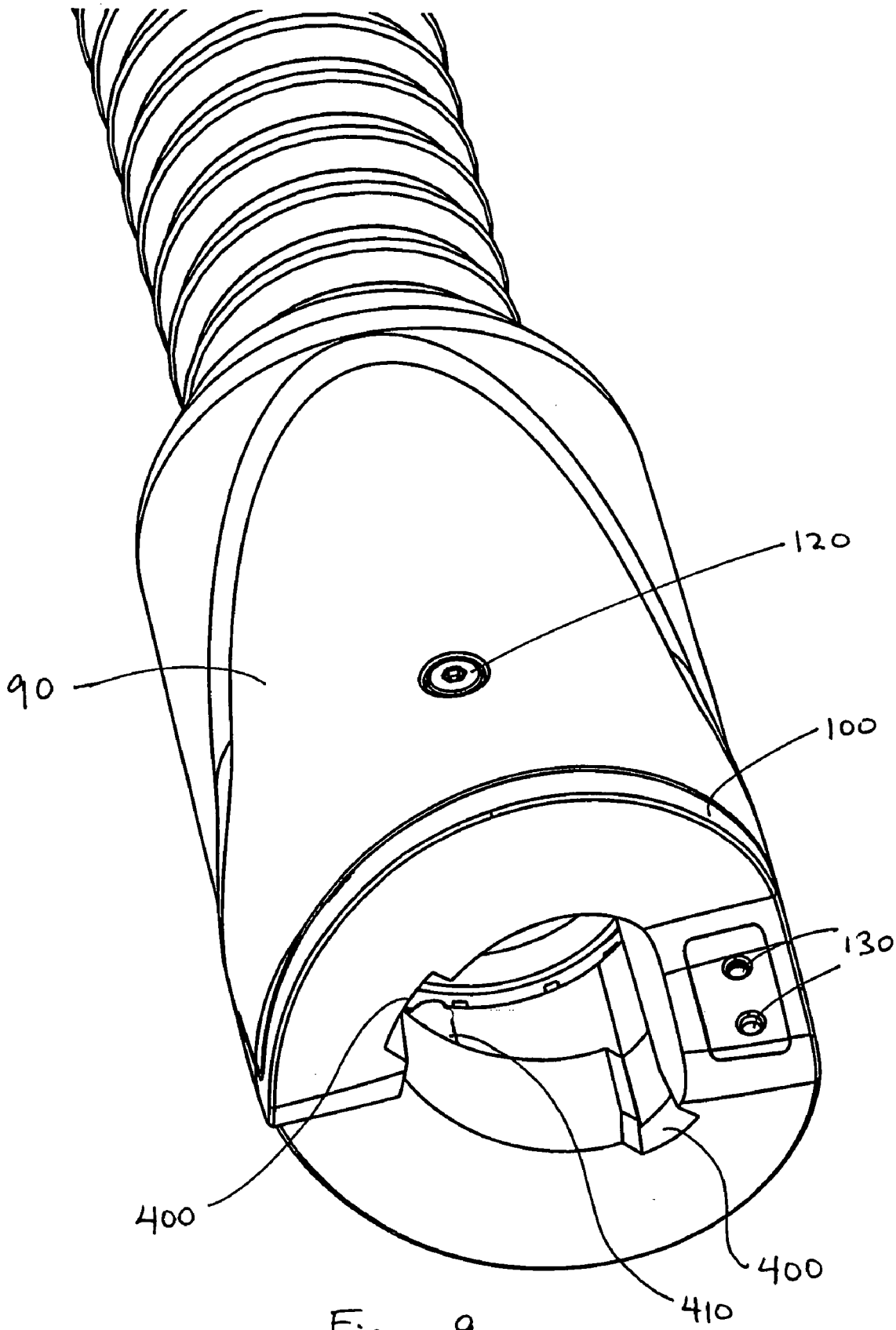
FIG. 9 is a perspective view of the female connection end shown in FIG. 2.

FIG. 7 shows the male connection end and the female connection end in a partially engaged position. To achieve this position, the guide buttons 70 on the male connection end 10 are first slid through the guide button receiving channels 400 in female connection end 80, as illustrated in FIG. 9. With the guide buttons 70 in position, a twisting action will result in the male receptor plugs 50 being guided into place within the female receptor holes 130 each time the ends are connected. A guide button receptor 410 helps keep the male and female connection ends 10 and 80 held together when in fully engaged position.

Figure 8:
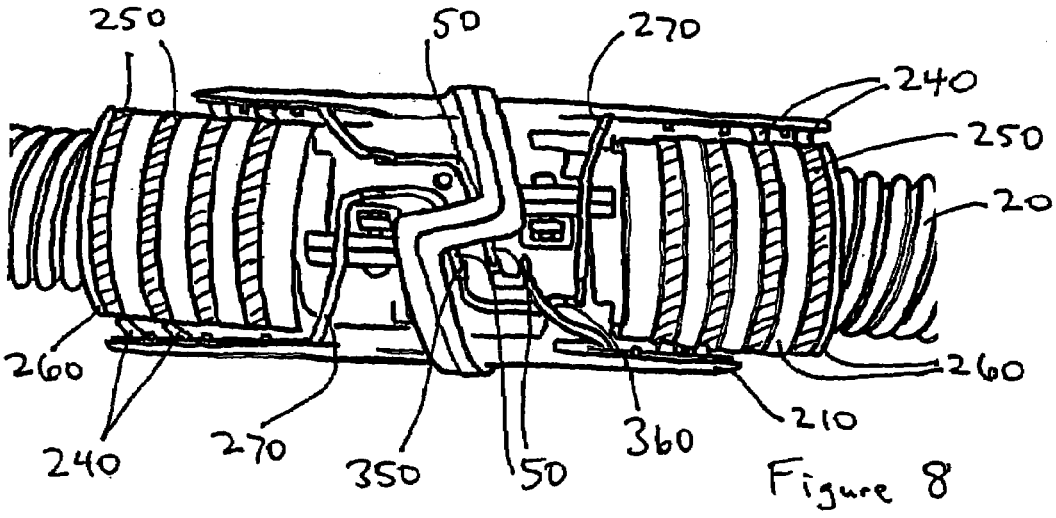
FIG. 8 is a side view of the male and female connection ends shown in FIGS. 1 and 2 with the hard covers removed and in a fully engaged position.

FIG. 8 shows the male and female connection ends 10 and 80 in fully engaged position. Female receptor leads 350 contact the male receptor plugs 50 when the male and female connection ends 10 and 80 are in the fully engaged position. The female receptor leads 350 are in electrical communication with insulated receptor wires 270 via electrical circuit pathways 360. The remaining inner workings of the female connection end 80 are similar to the male connection end 10, including conducting loops 250, insulating loops 260, short and long flanges 210 and 220, and conducting leads 240.

Figure 10:
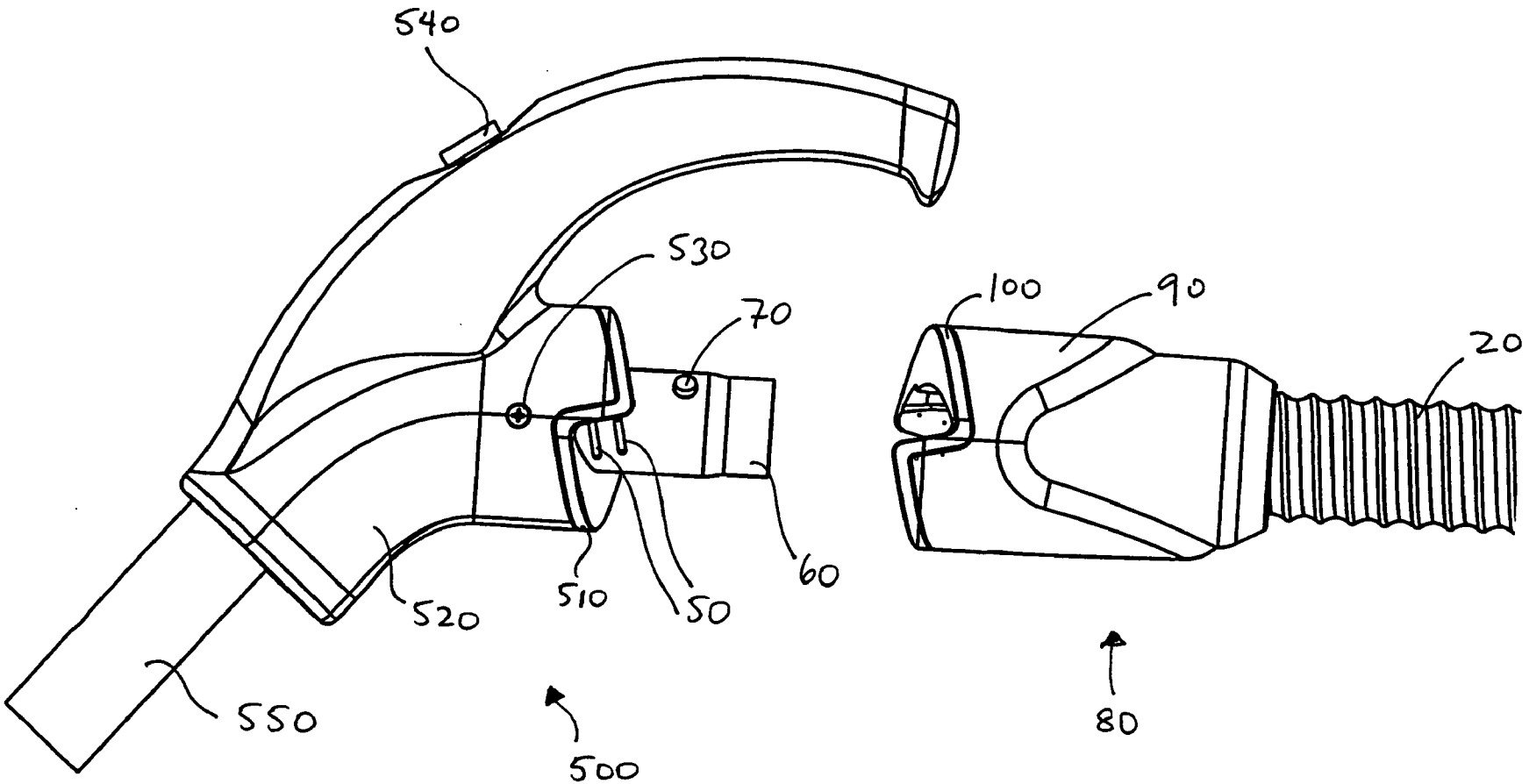
FIG. 10 is a side view of a preferred embodiment handle part male connection end along with the female connection end shown in FIG. 2.

FIG. 10 shows a handle part 500 along with a female connection end 80. The handle part 500 has male receptor plugs 50 and an inner vacuum tube member 60 with a guide button 70, all similar to the male connection end 10. The handle part 500 has a leading end 510 and a hard protective cover 520. The handle part 500 is further shown with an on/off switch 540 and with an inner vacuum tube pipe 550.

As can be appreciated with references to FIGS. 1 to 10, the preferred embodiment uses the same type of connection between the vacuum cleaner current-carrying hose 20 and a second or third vacuum cleaner extension hose as it does with the handle part 500. This will allow for easy operation with a single vacuum hose or with any number of extensions of similar vacuum hoses, which may or may not be of similar length to the first hose. As described briefly above, the front portion of the connection ends 10 and 80, including the hard covers 30 and 90 are freely rotatable about the longitudinal axis of the connection end. The preferred embodiment provides a simple and easy to use mechanism to connect a vacuum hose to a handle part 500 or to a second vacuum hose without requiring the pushing of buttons or straight pulling apart of connections. Engaging and unengaging the connection can be carried out by twisting.

Inner vacuum tube pipe 550 is in communication with inner vacuum tube member 60 and may form a single tube.

Figure 11:
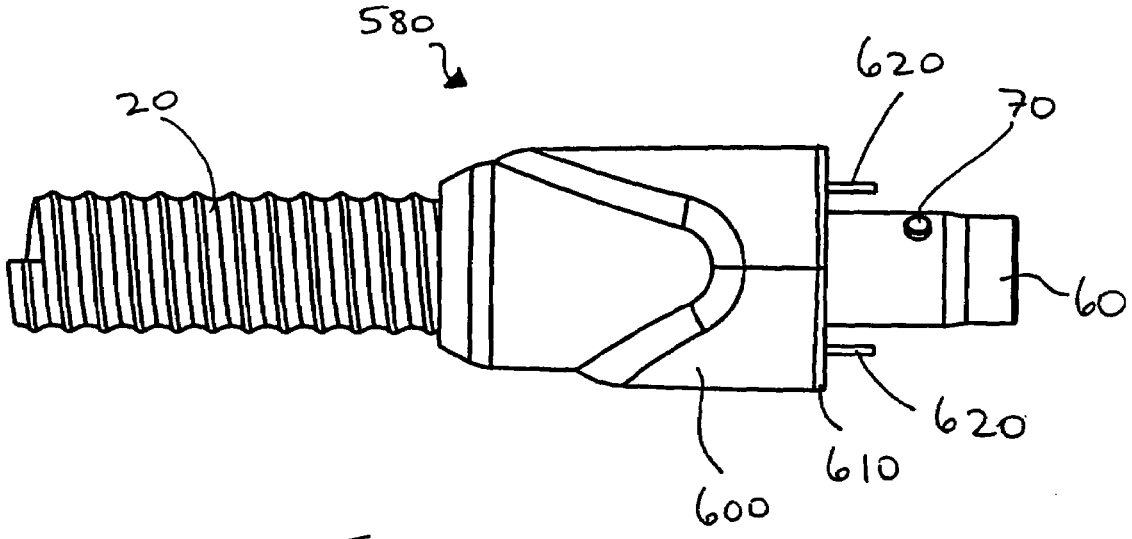
FIG. 11 is a side view of a second embodiment of a male connection end.
Figure 12:
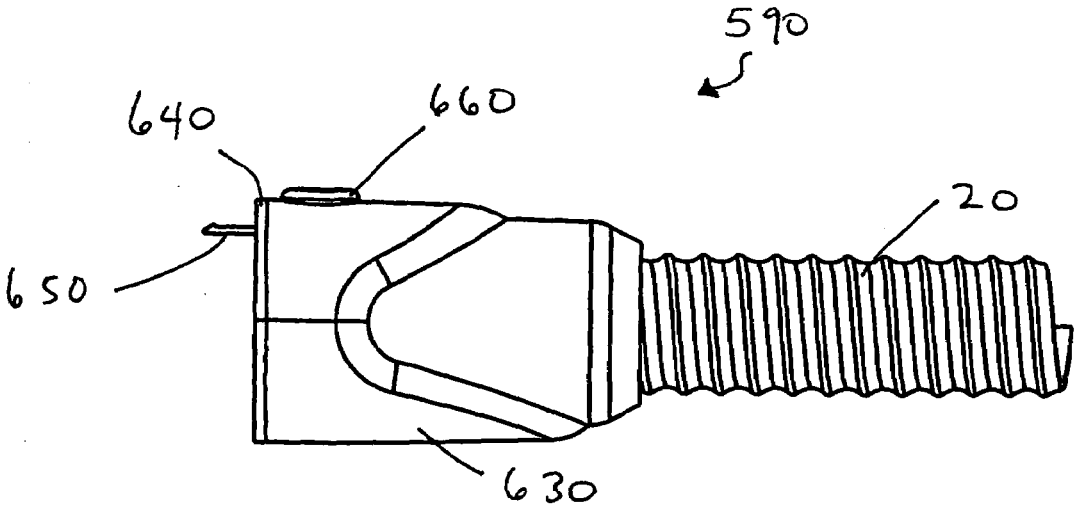
FIG. 12 is a side view of a second embodiment of a female connection end.

FIGS. 11 and 12 show a male connection end 580 and a female connection end 590 according to a second embodiment of the invention. The male receptor end has four male receptor plugs 620, a straight leading lip 610, and a hard protective shell 600. The female receptor end has female receptor holes (not shown) that will line up with the male receptor plugs 620. The female connection end has a connection mechanism 650 in communication with a connection mechanism button 660. The connection mechanism 650 fits into a corresponding receptor hole (not shown) in the male connection end 580.

Figure 13:
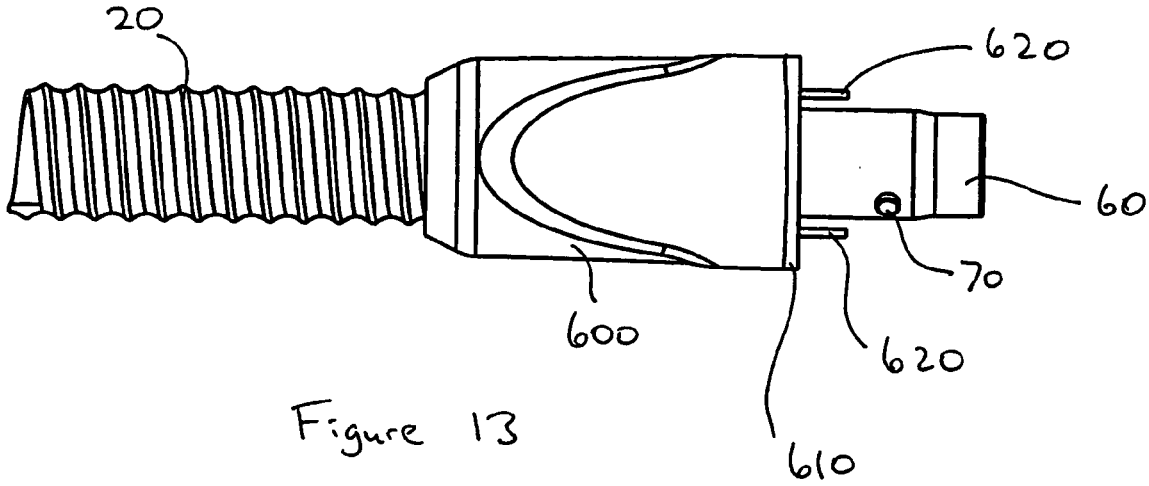
FIG. 13 is a top view of the male connection end shown in FIG. 11.
Figure 14:
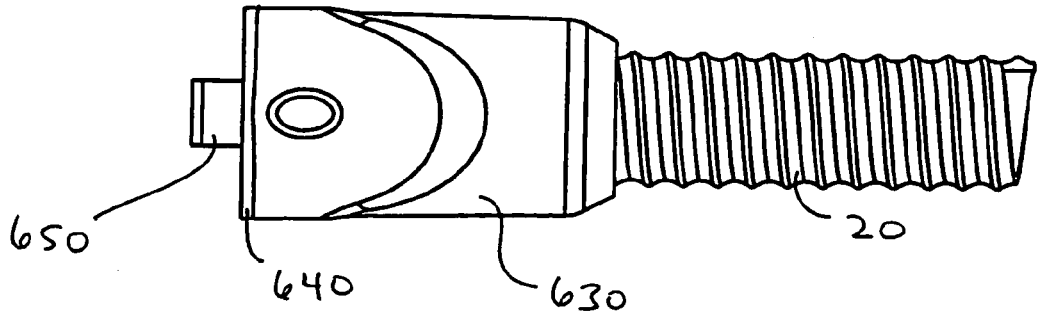
FIG. 14 is a top view of the female connection end shown in FIG. 12.

FIGS. 13 and 14 show top views of the male and female connection ends according to the second embodiment.

Figure 15:
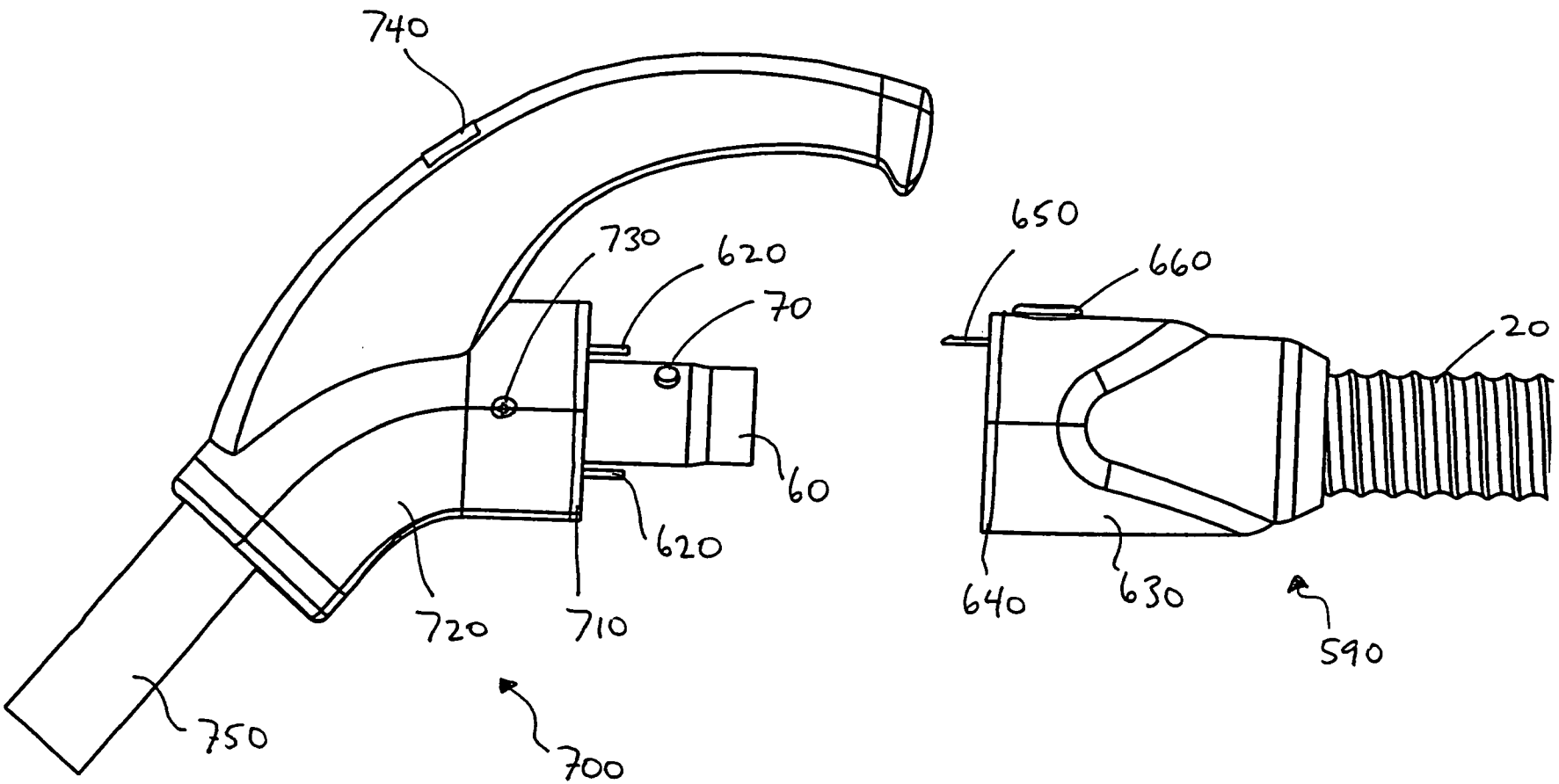
FIG. 15 is a side view of a second embodiment handle part male connection end along with the female connection end shown in FIG. 12.

FIG. 15 shows a handle part 700 with a female connection end 590 according to the second embodiment of the invention. The handle part 700 has male receptor plugs 620, an inner vacuum tube member 60 and guide buttons 70 similar to the male connection end 580. The handle part 700 has a leading lip 710 and a hard shell cover 720. The handle part 700 further shows an on/off button 740 and an inner vacuum tube pipe 750. As will be appreciated with references to FIGS. 11 to 15, the second embodiment has a straight leading edge connection between the male and female parts. The use of the uniform male and female connection end system allows the easy insertion or removal of an extension hose between a first vacuum hose and a handle part.

A basic implementation of the invention requires a male/female connection system at one end of the main hose. The connection system can connect the hose to a vacuum cleaner body or to a wall outlet of a built in vacuum cleaner at one end and/or it could connect the hose to the handle part. This description has described the connection system applying between a hose and a handle part, however it is to be understood that this system could be used between a hose and a vacuum cleaner's main body or a wall outlet. It is further possible to have a connection system at both ends of the main hose, in which case the main hose would likely have one male connection end and one female connection end according to this invention. Implementing the connection system at both ends of the main vacuum cleaner hose, namely to connect to the handle part and to the main body, would allow a main hose to have both a male connection end and a female connection end, allowing main and extension hoses to be interchangeable.

Connecting two hoses together according to the invention provides a swivel at the join of the hoses, which reduces or eliminates kinking in the middle of the extended hose. The ease of opening the join between two hoses further facilitates access to any clogs that may have occurred in the extended hose.

As will be apparent to those skilled in the art in the light of the foregoing disclosure, many alterations and modifications are possible in the practice of this invention without departing from the spirit or scope thereof. For example, current-carrying vacuum hoses have been described as having a current-carrying cord wound round in a helix, however it is to be understood that this invention can be practiced with cords that carry a relatively straight current-carrying cord inside or outside the vacuum cord. Accordingly, the scope of the invention is to be construed in accordance with the substance defined by the following claims.

What is claimed is:

1. A vacuum cleaner hose connection system comprising:

a male connection end having at least two male receptor plugs for transmitting current;

a female connection end having at least two female receptor holes for receiving the male receptor plugs and transmitting current;

the male and female connection ends being rotatably movable, about the longitudinal axis of at least one of the female connection end and the male connection end, between an unengaged position and an engaged position.

2. A vacuum cleaner hose connection system as in claim 1, the male connection end having a guide button for receipt in a guide button receiving channel fashioned in the female connection end.

3. A vacuum cleaner hose connection system as in claim 1, the female connection end having a guide button for receipt in a guide button receiving channel fashioned in the male connection end.

4. A vacuum cleaner hose connection system as in claim 1 wherein a portion of the male connection end having the male receptor plugs is freely rotatable, with respect to the current-carrying hose, about a longitudinal axis of the male connection end.

5. A vacuum cleaner hose connection system as in claim 1 wherein a portion of the female connection end having the female receptor holes is freely rotatable, with respect to the current-carrying hose, about a longitudinal axis of the female connection end.

6. A vacuum cleaner hose connection system as in claim 1 wherein the male connection end further comprises a plurality of conducting loops spaced apart by a plurality of insulating loops.

7. A vacuum cleaner hose connection system as in claim 1 wherein the female connection end further comprises a plurality of conducting loops spaced apart by a plurality of insulating loops.

8. A vacuum cleaner hose connection system as in claim 1 wherein the male connection end has a plurality of male receptor plugs at a plurality of locations along a front leading lip of the male connection end.

9. A vacuum cleaner hose connection system as in claim 8 wherein the female connection end has a plurality of female receptor holes at a plurality of locations along a front leading lip of the female connection end.

10. A vacuum cleaner current-carrying hose comprising the male connection end and the female connection end claimed in claim 1.

11. A vacuum cleaner handle part comprising a male connection end configured to be rotationally moveable between an unengaged position and a position engaged with a female connection end of a vacuum cleaner current-carrying hose.

12. A female connection end for a vacuum cleaner current-carrying hose comprising:

at least two female receptor holes for receiving male receptor plugs carrying current; and means for engaging with a male connection end having the male receptor plugs, via rotation about a longitudinal axis of the female connection end.

13. A male connection end for a vacuum cleaner current-carrying hose comprising:

at least two male receptor plugs for transmitting current to female receptor holes; and means for engaging with a female connection end having the female receptor holes, via rotation about a longitudinal axis of the male connection end.

14. A method for operating a connection system between a first vacuum cleaner current-carrying hose and one of a second vacuum cleaner current-carrying hose, a handle part, a vacuum cleaner body and a wall outlet, comprising:

rotating a male connection end, with respect to a female connection end about the longitudinal axis of at least one of the female connection end and the male connection end, to engage a current-carrying male plug of the male connection end with a current-carrying female receptor of the female connection end, wherein one of the male connection end and the female connection end is coupled to the first current-carrying vacuum cleaner hose and wherein the other of the male connection end and the female connection end is coupled to one of the second vacuum cleaner current-carrying hose, the handle part, the vacuum cleaner body and the wall outlet.

15. A method as in claim 14 further comprising rotating the male connection end, with respect to the female connection end about the longitudinal axis of at least one of the female connection end and the male connection end, to disengage the current-carrying male plug of the male connection end from the current-carrying receptor of the female connection end.

* * * * *